US010352198B2

(12) United States Patent
Gibble

(10) Patent No.: US 10,352,198 B2
(45) Date of Patent: Jul. 16, 2019

(54) METHOD AND APPARATUS BOTTOMING CYCLE WORKING FLUID ENTHALPY CONTROL IN A WASTE HEAT RECOVERY APPARATUS

(71) Applicants: John Gibble, Chambersburg, PA (US); VOLVO TRUCK CORPORATION, Göteborg (SE)

(72) Inventor: John Gibble, Chambersburg, PA (US)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 15/579,333

(22) PCT Filed: Jun. 3, 2015

(86) PCT No.: PCT/US2015/033920
§ 371 (c)(1),
(2) Date: Dec. 4, 2017

(87) PCT Pub. No.: WO2016/195670
PCT Pub. Date: Dec. 8, 2016

(65) Prior Publication Data

US 2018/0195418 A1 Jul. 12, 2018

(51) Int. Cl.
*F01K 23/06* (2006.01)
*B01F 5/04* (2006.01)
(Continued)

(52) U.S. Cl.
CPC ..... *F01K 23/06* (2013.01); *B01F 5/0413* (2013.01); *F01K 9/00* (2013.01); *F01K 9/02* (2013.01);
(Continued)

(58) Field of Classification Search
CPC ... F01K 23/06; F01K 9/00; F01K 9/02; F01K 21/00; B01F 5/0413
(Continued)

(56) References Cited

U.S. PATENT DOCUMENTS 3,636,706 A * 1/1972 Minto ..... F01K 21/005 55/459.1
4,191,021 A * 3/1980 Nakamura ..... F01K 25/08 60/646
(Continued)

FOREIGN PATENT DOCUMENTS

DE 102012223024 A1 6/2014
WO 2014123572 A1 8/2014

OTHER PUBLICATIONS

International Search Report (dated Aug. 31, 2015) for corresponding International App. PCT/US2015/033920.
(Continued)

*Primary Examiner* — Hoang M Nguyen
(74) *Attorney, Agent, or Firm* — WRB-IP LLP

(57) ABSTRACT

A waste heat recovery apparatus, for use with an internal combustion engine, includes a working fluid circuit to circulate working fluid, a boiler connected on the working fluid circuit and adapted to recover waste heat from a source to heat working fluid, an expander connected on the working fluid circuit to receive working fluid from the boiler, and a condenser to receive and condense working fluid from the expander. A line carries condensed working fluid from the outlet side of the condenser to a mixer on the outlet side of the expander to lower the enthalpy of the working fluid entering the condenser.

14 Claims, 4 Drawing Sheets

(51) Int. Cl.

| | |
|---|---|
| ***F01K 9/02*** | (2006.01) |
| ***F01K 21/00*** | (2006.01) |
| ***F01K 9/00*** | (2006.01) |
| ***F01K 23/10*** | (2006.01) |

(52) U.S. Cl.
CPC ..... *F01K 21/00* (2013.01); *F01K 23/065* (2013.01); *F01K 23/10* (2013.01)

(58) Field of Classification Search
USPC ..... 60/670, 685
See application file for complete search history.

(56) References Cited

U.S. PATENT DOCUMENTS

| | | | | |
|---|---|---|---|---|
| 8,578,714 | B2 * | 11/2013 | Nagurny | F01K 13/00 60/645 |
| 2009/0277400 | A1 | 11/2009 | Conry | |
| 2012/0023946 | A1 | 2/2012 | Ernst et al. | |
| 2012/0255304 | A1 | 10/2012 | Li et al. | |

OTHER PUBLICATIONS

European Official Action (dated Apr. 23, 2019) from Corresponding European Appl 15894442.1.

* cited by examiner

METHOD AND APPARATUS BOTTOMING CYCLE WORKING FLUID ENTHALPY CONTROL IN A WASTE HEAT RECOVERY APPARATUS

FIELD OF THE INVENTION

The invention relates to bottoming cycle apparatuses, such as Rankine cycle apparatuses, for recovering energy from waste heat of internal combustion engines, and more particularly, to a method and apparatus for controlling working fluid enthalpy and, more particularly, to control a temperature of the working fluid entering the condenser.

BACKGROUND AND SUMMARY

In a bottoming cycle heat recovery apparatus, working fluid exiting the expander is directed to a condenser which removes sufficient heat from the working fluid to return it to liquid state. The heat load of the working fluid entering the condenser can make controlling the temperature of the condenser difficult.

The invention is directed to an apparatus that reduces the heat load on the condenser and is applicable to apparatuses for bottoming cycles such as the Rankine cycle or other thermodynamic cycles.

A bottoming cycle apparatus may include an expansion machine connected in a working fluid circuit to receive working fluid from a waste heat recovery heat exchanger, such as a boiler, vaporizer, or heat exchanger. The working fluid directed to an expansion machine is expanded in the expansion machine to generate usable work or energy. A condenser is connected on the working fluid circuit to receive working fluid from the expander, an accumulator or tank to receive and store condensed working fluid, and a pump connected on the working fluid circuit to receive working fluid exiting the condenser and direct the working fluid under pressure to the boiler. The apparatus according to the invention includes a mixer connected on the working fluid circuit downstream of the expander and upstream of the condenser, the working fluid circuit having a line connected to deliver working fluid to the mixer from downstream of the condenser.

According to the invention, the waste heat recovery apparatus includes a valve on the working fluid circuit downstream of the condenser to control a flow of working fluid to the boiler and the mixer. The valve is preferably located downstream of the pump.

The waste heat recovery apparatus may include a bypass valve disposed on the working fluid circuit between the boiler and the expander and a bypass line connecting the bypass valve and the mixer.

The expander may include a cooling jacket and the apparatus may include a line connected to deliver working fluid to the cooling jacket from downstream of the condenser, the working fluid circuit further including a line connected to deliver working fluid exiting the cooling jacket to the mixer. According to this embodiment, the waste heat recovery apparatus may include a valve disposed on the working fluid circuit downstream of the condenser to control a flow of working fluid to the boiler and the cooling jacket.

According to yet another embodiment, the waste heat recovery apparatus includes a mixer having at least one of a Venturi mixer device, an injector, and an ejector mixer device.

DETAILED DESCRIPTION

Figure 1:
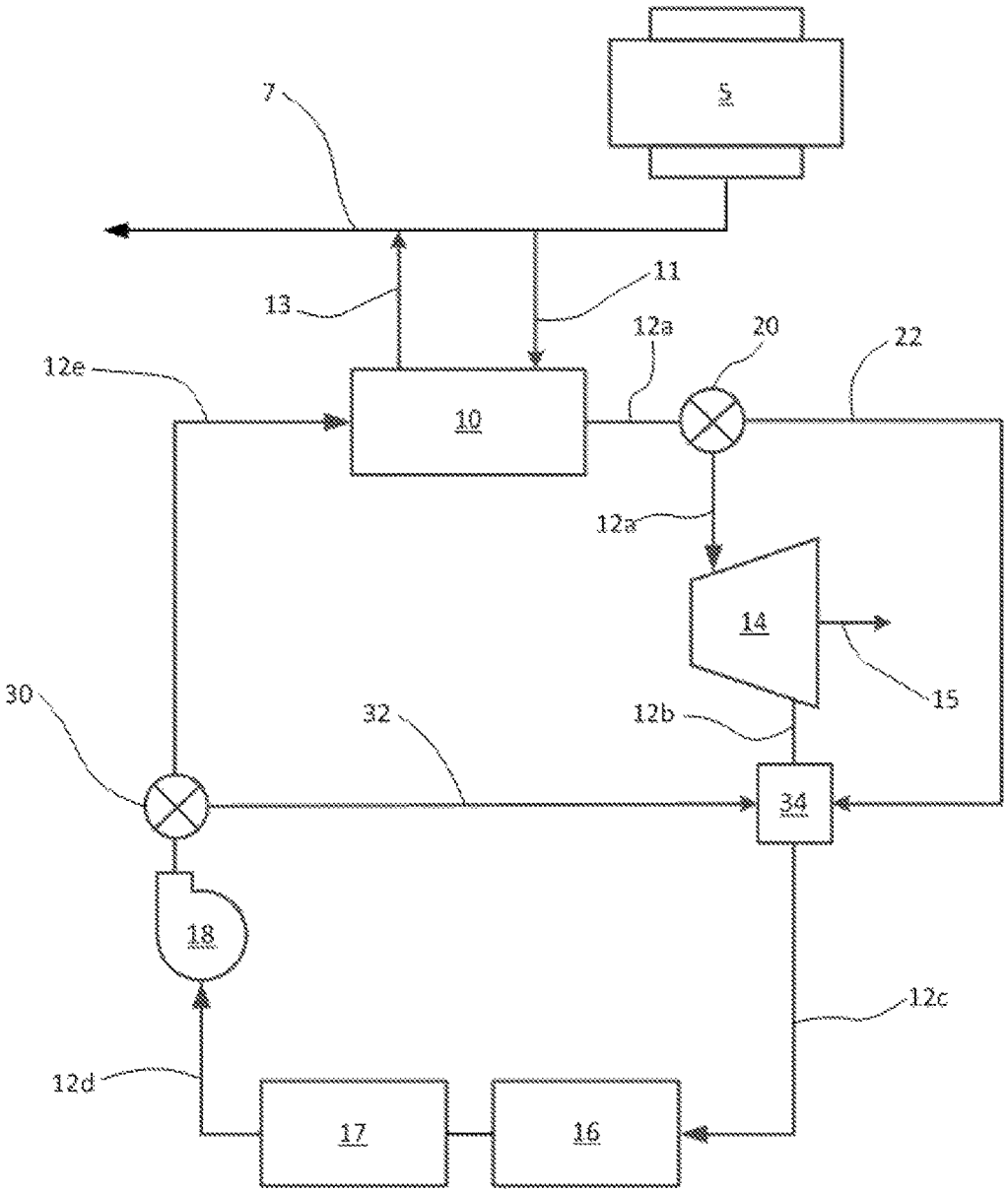
FIG. 1 is a schematic view of a bottoming cycle apparatus according to a first embodiment of the invention.

As seen in FIG. 1, a bottoming cycle waste heat recovery apparatus includes a vaporizer or boiler 10 to heat a working fluid, an expander 14 to convert heat energy in the working fluid into mechanical work, a condenser 16 to remove residual heat from the working fluid after expansion, an accumulator 17 to receive and store condensed working fluid, and a pump 18 to return the condensed working fluid to the boiler.

The boiler 10 is connected to recover heat from a heat source, such as waste heat from an internal combustion engine exhaust, engine coolant, engine oil cooler, or other source, to heat the working fluid. An internal combustion engine 5 having an exhaust 7 is illustrated by way of example. An inflow line 11 at a boiler inlet conducts the waste heat-carrying medium (e.g., exhaust gas) into the boiler 10 and an outflow line 13 carries the medium out of the boiler after heat exchange with the working fluid.

Working fluid is carried through the waste heat recovery apparatus by a working fluid circuit 12. The heated working fluid exiting the boiler 10 is directed through a working fluid circuit line 12*a* to the expansion machine or expander 14, which generates work by expanding the working fluid. The expander 14 may be a turbine, a piston engine, a scroll, a screw, or other machine. The generated work may be transmitted through an output shaft 15, and may be used, for example, to drive an electrical generator or a compressor, or as mechanical power added to the drive shaft of the internal combustion engine.

Expanded working fluid is directed through the circuit lines 12*b* and 12*c* to the condenser 16, which removes residual heat from and condenses the working fluid. The condensed working fluid is then directed through a circuit line 12*d* to the pump 18, which compresses the working fluid. A circuit line 12*e* carries the working fluid from the pump 18 to the boiler 10 to repeat the waste heat recovery cycle.

As seen in FIG. 1, and as known in the art, a bottoming cycle waste heat apparatus may include a bypass circuit 22 controlled by a bypass valve 20 to selectively direct working fluid around the expander 14. The bypass valve 20 may be controlled to direct the working fluid to the expander 14 through line 12*a* when the working fluid is at operational condition, or through line 22 to bypass the expander 14 when power generation by the expander is not desired or when the quality of the working fluid is not sufficient for expansion. The quality of the working fluid may not be sufficient for expansion when there is not enough waste heat available at the boiler 10 to heat the working fluid to an operational temperature, for example, as superheated steam. Working fluid that bypasses the boiler 10 is carried by line 12*c* to the condenser 16 where it is cooled. The cooled working fluid is pumped by the pump 18 to the vaporizer/boiler 10.

According to the invention, a valve 30 is placed on line 12*e* downstream of the pump 18 to direct a quantity of condensed working fluid to mix with working fluid exiting the expander 14, upstream of the condenser 16. The valve 30 directs working fluid through line 32 to a mixer 34 disposed on circuit line 12*b*. The cooled and condensed working fluid diverted by valve 30 is mixed with the working fluid, still in vapor phase, exiting the expander 10 and absorbs heat energy from the vapor working fluid. A significant amount of heat is absorbed by the condensed working fluid vaporizing to steam. The mixed working fluids, which present a reduced heat load as compared to the working fluid exiting the expander 14, are directed to the condenser 16 through line 12*c*.

The bypass line 22 connects to the mixer 34. Working fluid that bypasses the expander 14, if not of a quality for extracting work, may still carry heat that presents a heat load to the condenser 16. The valve 30 may be controlled to divert a portion of the condensed working fluid from line 12*e* to the mixer 34. Mixing condensed working fluid from line 12*e* with the bypass fluid from line 22 reduces the heat load on the condenser 16.

Figure 4:
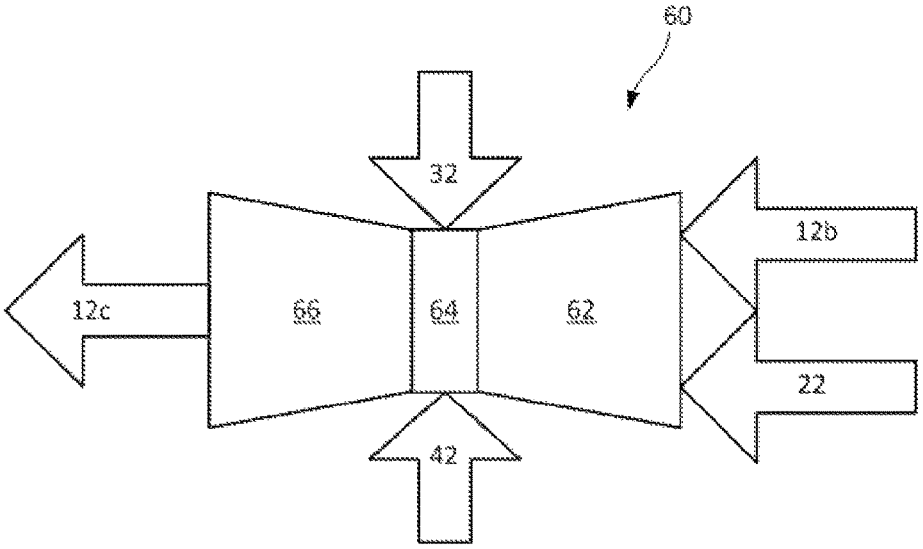
FIG. 4 is a schematic view of a Venturi mixer which may be incorporated in an apparatus according to the invention; and, FIG. 5 is a schematic view of an ejector mixer which may alone or in combination with the Venturi mixer of FIG. 4 be incorporated in an apparatus according to the invention.
Figure 5:
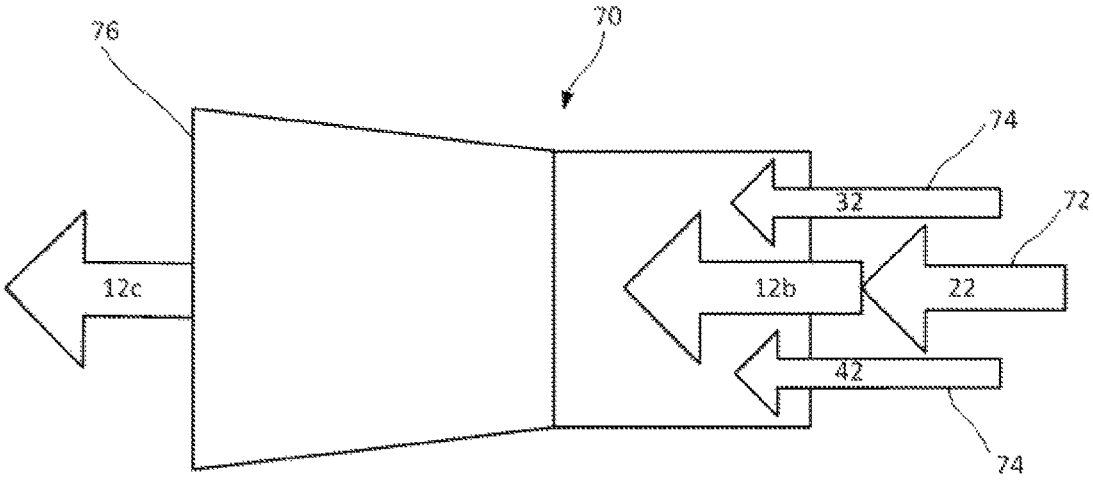

The mixer 34 may be a chamber formed on or attached to the line 12*b* where the various fluids can enter and mix. The mixer 34 may be an enlarged section of the working fluid line 12*b*. The mixer 34 may be a section of the line 12*b* where the other lines join. Various devices, alone or in combination, can be used with the mixer 34 to ensure good mixing of the various fluids. FIGS. 4 and 5, described below, illustrate two exemplary mixing devices.

Figure 2:
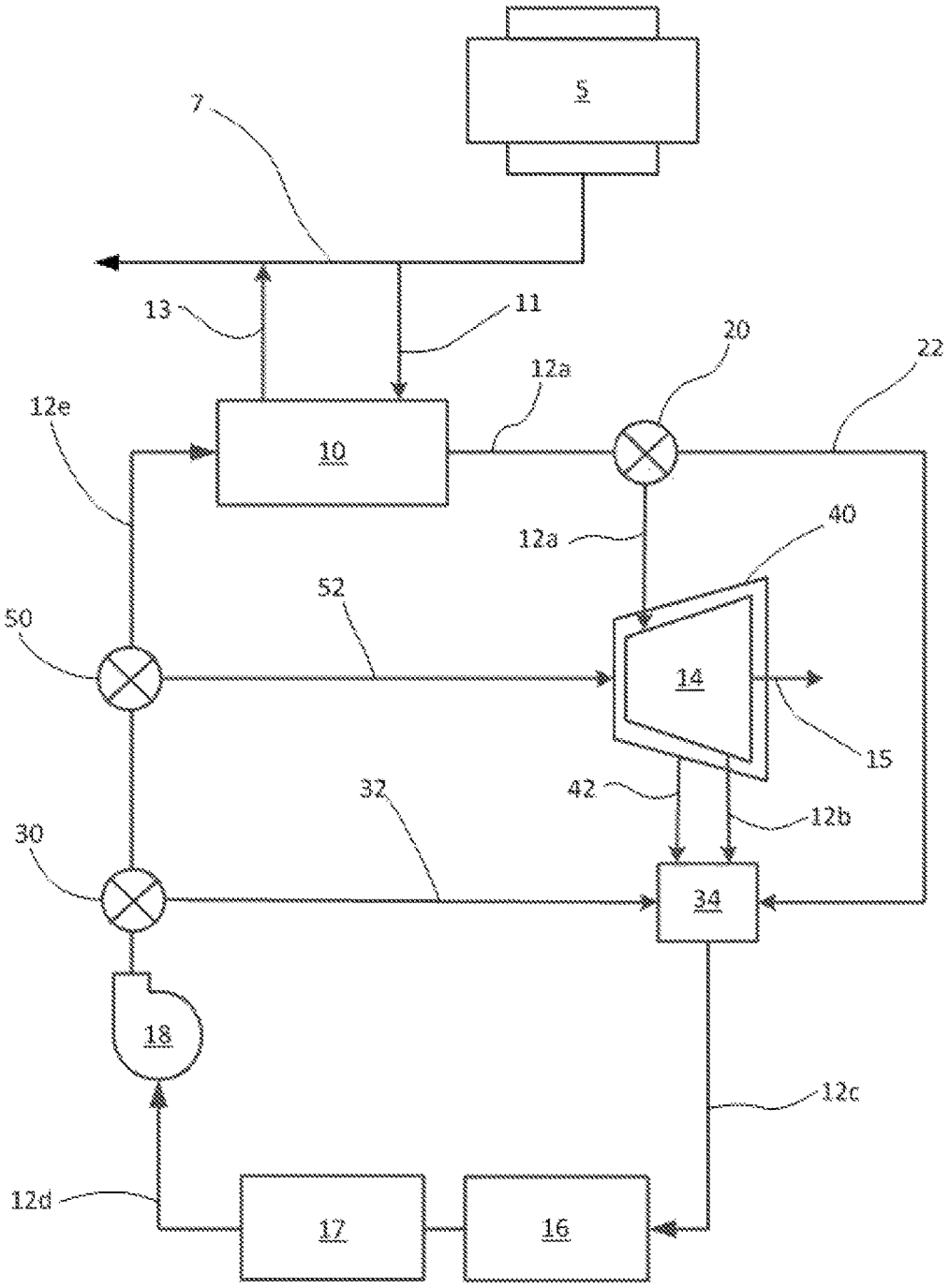
FIG. 2 is a schematic view of an apparatus according to a second embodiment.

FIG. 2 illustrates an alternative embodiment of the invention. FIG. 2 shows schematically a waste heat recovery apparatus similar to that of FIG. 1 and including a cooling jacket 40 on the expander 14. A valve 50 on the working fluid circuit line 12*e* downstream of the pump 18 directs a portion of the condensed working fluid through line 52 to deliver the working fluid to the cooling jacket 40. The working fluid received by the cooling jacket 40 flows through the cooling jacket and exits through line 42, where it is directed to the mixer 34. As in the embodiment of FIG. 1, valve 30 directs condensed working fluid through line 32 to the mixer 34, line 12*b* carries the working fluid exiting the expander 14 to the mixer, and the bypass line 22 also connects to the mixer.

Figure 3:
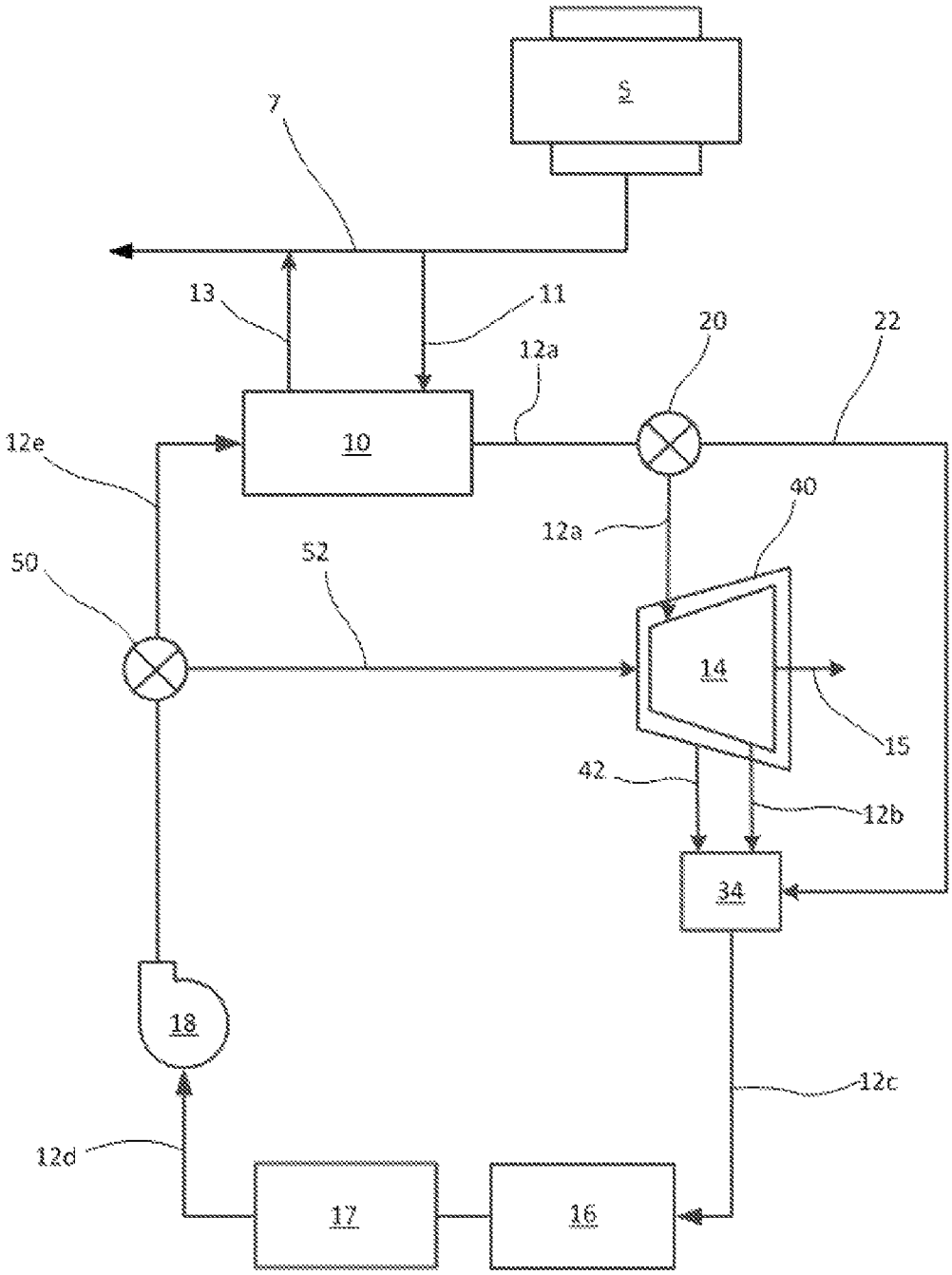
FIG. 3 is a schematic view of an apparatus according to a third embodiment.

FIG. 3 is a schematic of another embodiment. The apparatus of FIG. 3 includes an expander 14 with a cooling jacket 40 and a valve 50 on the circuit line 12*e* to direct condensed working fluid through line 52 to the cooling jacket 40. Unlike the apparatus of FIG. 2, the valve 30 directing condensed working fluid to the mixer 34 is omitted. According to the embodiment of FIG. 3, a sufficient amount of working fluid is supplied to the heating jacket 40 so that the working fluid remains in liquid state, but does not lower the temperature of the expander 14 enough to negatively affect the expansion process. Working fluid exiting the cooling jacket 40 through line 42 is directed to the mixer 34, where it mixes with expanded working fluid exiting the expander 14 through line 12*b*, where the cooling jacket working fluid absorbs heat energy from the expanded working fluid exiting the expander 14. If the bypass line 22 is open, the cooling jacket fluid in line 42 enters the mixer 34 to mix with bypass line fluid.

FIG. 4 is a schematic of a device for mixing the working fluids of various energy and pressure states. With reference to apparatus of FIG. 1, a Venturi mixer 60 is connected to receive at an inlet 62 one or both of the working fluid exiting the expander through line 12*b* and the working fluid carried by the bypass line 22. At the Venturi throat 64, the line 32 carrying the condensed working fluid is connected, the arrangement thus ensuring that the condensed working fluid is at a higher pressure than the expanded working fluid and/or the bypass line working fluid. Mixed working fluid exits the Venturi at outlet 66 into line 12*c*.

The device of FIG. 4 may be modified for the apparatus of FIG. 2 to connect the line 42 carrying working fluid exiting the cooling jacket 40 to the Venturi throat 64. Alternatively, two Venturi mixers may be arranged in series or parallel, with the line 42 carrying the cooling jacket fluid connected at the throat of one mixer and the line 32 carrying the condensed working fluid connected to the throat of the other Venturi mixer.

Similarly, the Venturi mixer 60 of FIG. 4 may be adapted for the apparatus of FIG. 3 to connect the line 42 carrying the working fluid exiting the cooling jacket 40 to the Venturi throat 62.

FIG. 5 shows schematically an ejector device 70 for ensuring mixing of the working fluid streams. The motive fluid, either the working fluid exiting the expander through line 12*b* or the bypass fluid carried in line 22, depending on the position of the bypass valve 20, are connected at the ejector inlet 72. The suction fluid, the condensed working fluid from line 32 and (for the apparatus of FIG. 2) the working fluid exiting the cooling jacket through line 42 are connected at a suction inlet 74. The fluids mix in the ejector and are discharged through the outlet 76 to line 12*c* to be carried to the condenser 16.

Two ejectors may be arranged in series or parallel to connect one motive fluid (the working fluid exiting the expander or the bypass fluid) and one suction fluid (the condensed working fluid or the working fluid exiting the cooling jacket) to each ejector.

Alternatively, depending on the temperature and pressure of the various working fluid streams, a Venturi device 60 may be used in combination with an ejector device 70.

The invention has been described in terms of preferred principles, embodiments, and components. Those skilled in the art will understand that substitutions may be made for the components shown without departing from the scope of the invention as defined by the appended claims.

The invention claimed is:

1. A waste heat recovery apparatus, comprising:

a working fluid circuit to circulate working fluid;

a boiler connected on the working fluid circuit and adapted to recover waste heat from a source and transfer recovered waste heat to the working fluid;

an expander connected on the working fluid circuit to receive working fluid from the boiler;

a condenser connected on the working fluid circuit to receive working fluid from the expander, a pump connected on the working fluid circuit to receive working fluid exiting the condenser and direct the working fluid under pressure to the boiler, a mixer connected on the working fluid circuit downstream of the expander and upstream of the condenser, the working fluid circuit having a line connected downstream of the condenser to deliver working fluid cooled and condensed by the condenser to the mixer, and a bypass valve disposed on the working fluid circuit between the boiler and the expander and a bypass line connecting the bypass valve and the mixer.

2. The waste heat recovery apparatus of claim 1, comprising a valve on the working fluid circuit downstream of the condenser to control a flow of working fluid to the boiler and the mixer.

3. The waste heat recovery apparatus of claim 2, wherein the valve is located downstream of the pump.

4. A waste heat recovery apparatus, comprising:

a working fluid circuit to circulate working fluid;

a boiler connected on the working fluid circuit and adapted to recover waste heat from a source and transfer recovered waste heat to the working fluid;

an expander connected on the working fluid circuit to receive working fluid from the boiler;

a condenser connected on the working fluid circuit to receive working fluid from the expander, a pump connected on the working fluid circuit to receive working fluid exiting the condenser and direct the working fluid under pressure to the boiler, and, a mixer connected on the working fluid circuit downstream of the expander and upstream of the condenser, the working fluid circuit having a line connected to deliver working fluid to the mixer from downstream of the condenser, wherein the expander has a cooling jacket and comprising a line connected to deliver working fluid to the cooling jacket from downstream of the condenser.

5. The waste heat recovery apparatus of claim 4, comprising a line connected to deliver working fluid exiting the cooling jacket to the mixer.

6. The waste heat recovery apparatus of claim 4, comprising a valve disposed on the working fluid circuit downstream of the condenser to control a flow of working fluid to the boiler and the cooling jacket.

7. The waste heat recovery apparatus of claim 1, wherein the expander has a cooling jacket and wherein the line connected to deliver working fluid to the mixer from downstream of the condenser connects to the cooling jacket and an outlet line of the cooling jacket connects to the mixer.

8. The waste heat recovery apparatus of claim 1, wherein the mixer comprises at least one of a Venturi mixer device and an ejector mixer device.

9. A waste heat recovery apparatus, comprising:

a working fluid circuit to circulate working fluid;

a boiler connected on the working fluid circuit and adapted to recover waste heat from a source and transfer recovered waste heat to the working fluid;

an expander connected on the working fluid circuit to receive working fluid from the boiler, the expander having a cooling jacket;

a condenser connected on the working fluid circuit to receive working fluid from the expander, a pump connected on the working fluid circuit to receive working fluid exiting the condenser and direct the working fluid under pressure to the boiler, and, a mixer connected on the working fluid circuit downstream of the expander and upstream of the condenser, the working fluid circuit having a line connected to deliver working fluid to the expander cooling jacket from downstream of the condenser and an outlet line of the cooling jacket connected to the mixer.

10. The waste heat recovery apparatus of claim 9, comprising a valve on the working fluid circuit downstream of the condenser to control a flow of working fluid to the boiler and the mixer.

11. The waste heat recovery apparatus of claim 10, wherein the valve is located downstream of the pump.

12. The waste heat recovery apparatus of claim 9, comprising a bypass valve disposed on the working fluid circuit between the boiler and the expander and a bypass line connecting the bypass valve and the mixer.

13. The waste heat recovery apparatus of claim 9, comprising a valve disposed on the working fluid circuit downstream of the condenser to control a flow of working fluid to the boiler and the cooling jacket.

14. The waste heat recovery apparatus of claim 9, wherein the mixer comprises at least one of a Venturi mixer device and an ejector mixer device.

* * * * *